US006620311B2

(12) United States Patent
Morel et al.

(10) Patent No.: US 6,620,311 B2
(45) **Date of Patent: *Sep. 16, 2003**

(54) PROCESS FOR CONVERTING PETROLEUM FRACTIONS, COMPRISING AN EBULLATED BED HYDROCONVERSION STEP, A SEPARATION STEP, A HYDRODESULPHURIZATION STEP AND A CRACKING STEP

(75) Inventors: Frédéric Morel, Francheville (FR); Stéphane Kressmann, Serezin du Rhone (FR); James Colyar, Newtown, PA (US)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 156 days.

This patent is subject to a terminal disclaimer.

(21) Appl. No.: 09/757,602

(22) Filed: Jan. 11, 2001

(65) Prior Publication Data

US 2001/0027936 A1 Oct. 11, 2001

(30) Foreign Application Priority Data

Jan. 11, 2000 (FR) ..... 00 00368

(51) Int. Cl.[7] ..... C10G 45/00; C10G 45/02

(52) U.S. Cl. ..... 208/57; 208/58; 208/61; 208/100; 208/210; 208/209; 208/212

(58) Field of Search ..... 208/57, 58, 61, 208/100, 210, 209, 212

(56) References Cited

U.S. PATENT DOCUMENTS

| | | | | | |
|---|---|---|---|---|---|
| 3,098,029 | A | * | 7/1963 | Snyder, Jr. | 208/61 |
| 3,119,765 | A | * | 1/1964 | Corneil et al. | 208/210 |
| 3,887,455 | A | * | 6/1975 | Hamner et al. | 208/112 |
| 5,009,768 | A | * | 4/1991 | Galiasso et al. | 208/86 |
| 5,346,615 | A | * | 9/1994 | Savastano | |
| 5,851,381 | A | * | 12/1998 | Tanaka et al. | 208/210 |
| 5,980,730 | A | * | 11/1999 | Morel et al. | 208/96 |
| 6,007,703 | A | * | 12/1999 | Morel et al. | 208/210 |
| 6,017,441 | A | * | 1/2000 | Morel et al. | 208/96 |
| 6,117,306 | A | * | 9/2000 | Morel et al. | 208/89 |
| 6,153,087 | A | * | 11/2000 | Bigeard et al. | 208/89 |
| 6,207,041 | B1 | * | 3/2001 | Morel et al. | 208/89 |
| 6,277,270 | B1 | * | 8/2001 | Morel et al. | 208/58 |
| 6,280,606 | B1 | * | 8/2001 | Morel et al. | 208/58 |

* cited by examiner

*Primary Examiner*—Nadine G. Norton
(74) *Attorney, Agent, or Firm*—Millen, White, Zelano & Branigan, P.C.

(57) ABSTRACT

For converting hydrocarbons: step a) treating a hydrocarbon feed with hydrogen in at least one three-phase reactor (1), containing ebullated bed hydroconversion catalyst; a step b) passing effluent from step a) to a separation zone (2) to recover a fraction F1 containing at least a portion of gas, gasoline and atmospheric gas oil contained in the effluent from step a), and a fraction F2 containing compounds with boiling points of more than that of the atmospheric gas oil; step c) hydrodesulphurizing at least a portion of fraction F1; and step d) passing at least a portion of fraction F2 to catalytic cracking section (6).

30 Claims, 4 Drawing Sheets

Figure 1:
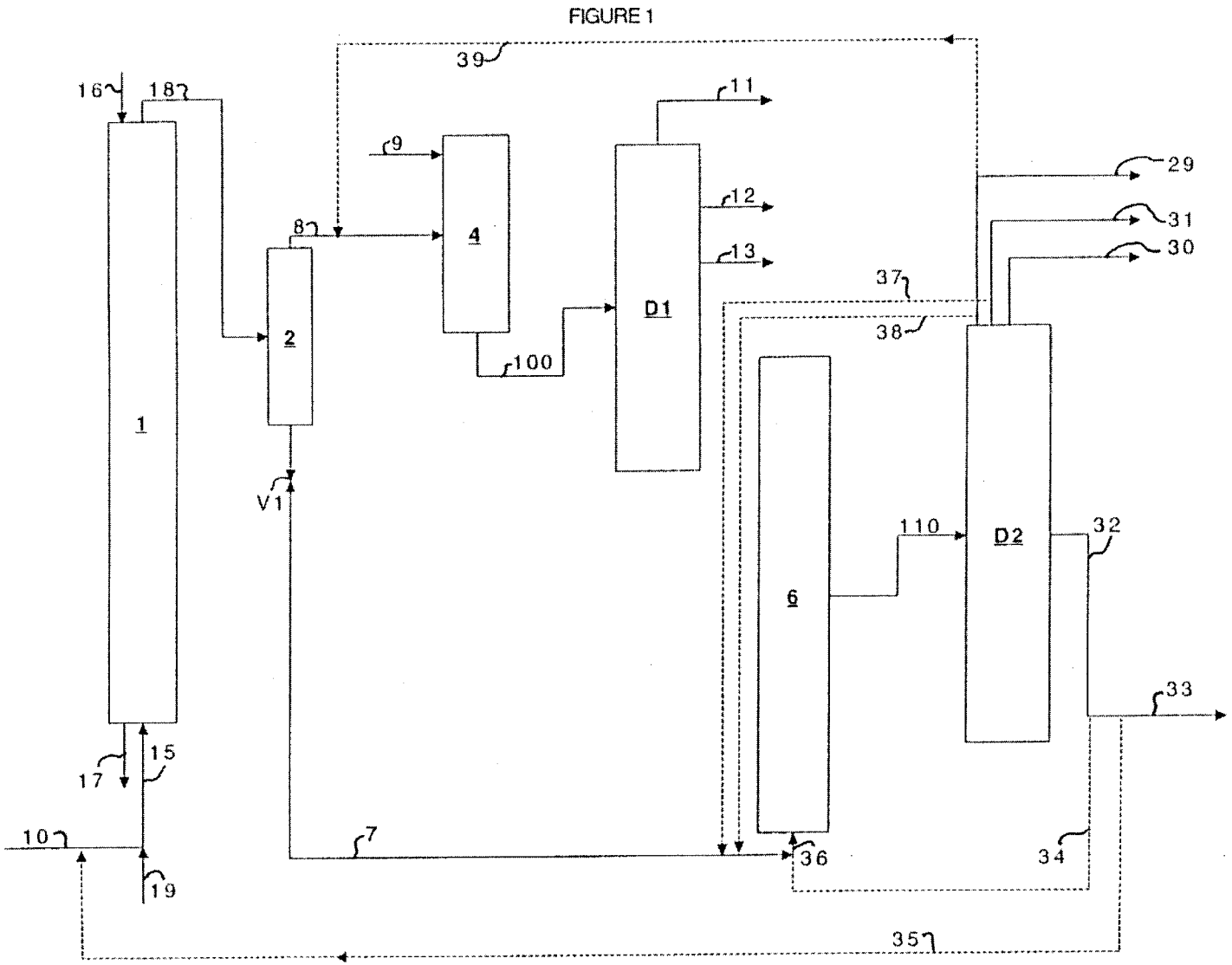

PROCESS FOR CONVERTING PETROLEUM FRACTIONS, COMPRISING AN EBULLATED BED HYDROCONVERSION STEP, A SEPARATION STEP, A HYDRODESULPHURIZATION STEP AND A CRACKING STEP

The present invention relates to refining and converting hydrocarbon fractions, in particular hydrocarbon distillates also comprising sulphur-containing impurities. More particularly, it relates to a process for converting at least a portion of a hydrocarbon feed, for example a vacuum distillate obtained from straight run distillation of a crude oil into very good quality light gasoline and gas oil fractions and to a heavier product which can be used as a feed for catalytic cracking in a conventional fluidised bed catalytic cracking unit and/or in a fluidised bed catalytic cracking unit comprising a double regeneration system and optionally a system for cooling the catalyst in the regeneration step. The catalytic cracking unit integrated into the process of the present invention can produce a gasoline with a very low sulphur content that can be mixed with the light gasoline fraction to form a mixed gasoline with a sulphur content that complies with regulations envisaged for 2005.

One aim of the present invention is to use certain particular hydrocarbon fractions that will be described below, to produce readily upgradeable lighter fractions such as middle distillates (engine fuel: gasoline and gas oil) by partial conversion of said fractions. One advantage of the present invention is to be able to improve the diesel to gasoline ratio in the refinery and thus to better respond to market requirements in many countries where diesel consumption is increasing more rapidly than gasoline consumption.

Within the context of the present invention, conversion of the feed to lighter fractions is normally in the range 20% to 100% if the unconverted heavy fraction is recycled, normally in the range 30% to 100%, and usually in the range 30% to 95%.

Feeds which can be treated by the process of the present invention are vacuum distillates, usually termed VD, such as straight run vacuum distillates, vacuum distillates from conversion processes such as those from coking, from fixed bed hydroconversion such as those from HYVAHL® processes for treating heavy hydrocarbons developed by the Applicant, or heavy hydrocarbon hydrotreatment processes carried out in an ebullated bed such as those from H-OIL® processes, or solvent deasphalted oils, for example using propane, butane or pentane deasphalted oils originating from deasphalting straight run vacuum residues or vacuum residues from H-OIL® or HYVAHL® processes. The feeds can also be formed by mixing those various fractions in any proportions, in particular deasphalted oil (DAO) and vacuum distillate. They can also contain a light cycle oil (LCO) of various origins, a heavy cycle oil (HCO) of various origins, and also gas oil cuts from catalytic cracking or coking generally with a distillation range of about 150° C. to about 370° C. They can also contain aromatic extracts obtained from manufacturing lubricating oils.

The aim of the present invention is to produce excellent quality products particularly with a very low sulphur content under relatively low-pressure conditions, to limit the cost of plant. This process can produce a gasoline type engine fuel containing less than 50 ppm (parts per million) by weight of sulphur thus satisfying the most strict regulations envisaged for 2005 governing sulphur content for this type of fuel, from a feed which may contain more than 3% by weight of sulphur. Similarly, and this is of particular importance, a diesel type engine fuel is obtained with a sulphur content of less than 50 ppm, therefore satisfying the most severe specifications envisaged for 2005 regarding the sulphur content in that type of fuel.

The prior art includes descriptions, in particular in U.S. Pat. Nos. 4,344,840 and 4,457,829, of processes for treating heavy hydrocarbon feeds comprising a first treatment step carried out in the presence of hydrogen in a reactor containing an ebullated catalyst bed followed by a second fixed bed hydrotreatment step. Those descriptions illustrate the case of fixed bed treatment, in the second step, of a light gas fraction from the product from the first step. The Applicant's recent French patent FR-A-2 769 635 describes a process for converting hydrocarbon cuts containing sulphur, comprising an ebullated bed treatment step carried out in the presence of hydrogen and a second step in which either all of the product from the first ebullated bed conversion step, or the liquid fraction from this step is treated, recovering the converted gas fraction in this first step. In this way, it is possible to carry out a treatment in the second step under favourable conditions leading to good stability of the system as a whole and to an improved selectivity for middle distillates compared with that obtained in the previous processes.

When Applicant is referred to it is the Applicant in the context of French practice which in the United States corresponds to the Assignee, namely Institut Francais du Petrole.

However, in view of the results obtained in that process as described in Example 2 of that patent application, it can be seen that the sulphur content of the gas oil fraction is more than 200 ppm and will therefore not satisfy 2005 regulations. Further, the conversion remains limited to about 65% by weight and it can be seen that the production of gas oil with respect to the feed remains less than 50% by weight while the motor cetane number is relatively low.

The aim of the present invention is to propose a process for increasing the production of middle distillates (in particular gas oil) in particular with a sulphur content that will satisfy specifications in 2005, while retaining the advantage of being able to operate at a moderate pressure with a high to very high conversion.

In its broadest sense, the present invention is defined as a process for converting a hydrocarbon fraction with a sulphur content of at least 0.05% by weight, normally at least 0.3%, usually at least 1% by weight and even exceeding 2% by weight, and an initial boiling point of at least 300° C., normally at least 340° C. and usually at least 360° C., and an end point of at least 400° C., usually at least 450° C., and which can be more than 600° C. or even 700° C., characterized in that it comprises the following steps.

a) treating the hydrocarbon feed (step a) in a converting section for treatment carried out in the presence of hydrogen, said section comprising at least one three-phase reactor, containing at least one hydroconversion catalyst, wherein the mineral support is at least partially amorphous, in an ebullated bed, operating in liquid and gas riser mode, said reactor comprising at least one means (17) for withdrawing catalyst from said reactor located close to the reactor bottom and at least one means (16) for supplying fresh catalyst to said reactor located close to the top of said reactor;

b) sending (step b) at least a portion, usually all, of the effluent EF0 from step a) to a separation section (2) operating at a pressure and temperature substantially identical to the pressure and temperature of the treatment section of step a), said separation section (2) producing, normally overhead, a fraction F1 normally containing at least a portion of the gas, gasoline and atmospheric gas oil contained in effluent EF0, and normally from the bottom, a fraction F2 normally principally containing compounds with higher boiling points than those of the atmospheric gas oil and a small proportion of compounds with boiling points lower than those of the atmospheric gas oil;

c) sending at least a portion, usually all, of the fraction F1 from step b) to a treatment section (step c), said treatment being carried out in the presence of hydrogen, said section comprising at least one reactor containing at least one fixed bed hydrodesulphurisation catalyst wherein the mineral support is at least partially amorphous, under conditions enabling an effluent EF1 with a reduced sulphur content to be obtained;

d) after expansion, sending at least a portion, usually all, of the fraction F2 from step b) to a catalytic cracking section (step d) in which it is treated under conditions that produce a cracking effluent EF2 normally containing a gas fraction, a gasoline fraction, a gas oil fraction and a slurry fraction.

Normally the treatment section of step a) comprises one to three reactors in series; the treatment section for step c) also comprises one to three reactors in series. In a preferred implementation of the process of the present invention, the treatment section for step a) comprises a single reactor.

In a normal implementation of the invention, at least part, normally all, of the effluent EF1 obtained in step c) is sent to a distillation zone (step e)) from which a gas fraction, a gasoline type engine fuel fraction and a gas oil type engine fuel fraction are recovered. Similarly, at least a portion, normally all, of the cracking effluent EF2 obtained in step d) is sent to a distillation zone (step f) from which a gas fraction, a gasoline type engine fuel fraction, a gas oil type engine fuel fraction and a slurry fraction are recovered.

In a variation, at least a portion, preferably all, of the fraction F2 from step b) is sent, after expansion, to a lower pressure separation section or to a fractionation column or to a steam stripper (step b1), from which a gas fraction is normally produced overhead that is normally evacuated to the other refinery units and that can, for example, be used as a fuel gas; a light fraction F3, which is normally a mixture of a gasoline fraction and an atmospheric gas oil fraction, at least a portion, preferably all, of which is sent to the treatment section of step c); and a heavy fraction F4, normally principally containing compounds with boiling points higher than those of the atmospheric gas oil, is normally obtained from the bottom, at least a portion of which, preferably all, is sent after to the catalytic cracking section of step d). In a variation, this lower pressure separation section can comprise means for separating a gas fraction that is for example eliminated or used in a further unit of the refinery, for example as a fuel, and means for recovering a mixed gasoline-diesel fraction which is sent to the fixed bed hydrodesulphurisation section after adjusting the pressure to a level close to that prevailing in said section.

In a particular implementation, which can be a preferred implementation when the catalyst used in step a) tends to form fine particles which over time can alter the function of the catalytic cracking section of step d), it is possible to provide a separation section (step g) for at least partial elimination of said fines before introduction into catalytic cracking step d) of fraction F2 from step b) following expansion. In the case where fraction F2 from step b) is sent to the lower pressure separation section or to a fractionation column of step b1) described above, this separation is preferably carried out before introducing the expanded fraction F4 from step b1) into catalytic cracking step d). This separation can be carried out using any known means. By way of example, it is possible to carry out said separation using at least one centrifuging system such as a hydrocyclone, or at least one filter.

In a particular implementation of this step g), at least two separation means are used in parallel, wherein at least one is used to carry out separation while at least one other is purged of retained fines.

The gas fraction obtained in steps e) or f) normally principally contain saturated and unsaturated hydrocarbons containing 1 to 4 carbon atoms in their molecule (such as methane, ethane, propane, butanes, ethylene, propylene, butylenes). This gas fraction is normally evacuated to other units in the refinery and can, for example, be used as a fuel gas. At least a portion of the gasoline type fraction obtained in step e) is, for example, sent to the refinery storage zone for this type of fuel (this storage zone is known as the gasoline fuel pool). At least a portion, preferably all, of the gasoline type fraction obtained in step f) is, for example, sent to the storage zone in the refinery for that type of fuel. At least a portion, preferably all, of the gas oil fraction obtained in step e) is sent to the gas oil fuel pool. At least a portion, preferably all, of the gas oil fraction obtained in step f) is sent to the gas oil fuel pool. At least a portion, preferably all, of the slurry fraction obtained in step f) is sent to the heavy fuel pool of the refinery, generally after separating the fine particles suspended in it. In a further implementation of the invention, at least a portion, or even all, of this slurry fraction is sent to the inlet to catalytic cracking step d). In a further implementation of the invention, at least a portion of this slurry fraction is returned either to step a), or to step d), or to each of these steps, generally after separating out the fine particles suspended in it.

In a particular implementation of the invention, it is possible to recycle at least a portion of the gasoline fraction either from step e) or from step f) or from both these steps to catalytic cracking step d) In a further implementation, it is possible to recycle at least a portion of the gas oil fraction from either step e) or step f), or from both steps either to catalytic cracking step d) or to fixed bed hydrodesulphurisation step c) or to the two steps,. Normally only at least a portion of the gas oil fraction from catalytic cracking step f) is recycled to hydrodesulphurisation step c) and/or catalytic cracking step d). In the present description, the term "a portion" of the slurry, gasoline or gas oil fraction is defined as being a fraction of less than 100%. When recycling one or more of these fractions to one or more treatment step(s) (for example step a) and step d) in the case of the slurry fraction, step c) and step d) in the case of the gas oil fraction; the totality of these portions does not necessarily represent all of said fraction. Within the context of the present invention, it is also possible to recycle all of the slurry fraction obtained by catalytic cracking either to step a) or to step d) and similarly all of the gas oil fraction obtained by catalytic cracking either to step c) or to step d), or a fraction to each of these steps, the sum of these fractions representing 100% of said fraction obtained in step d).

The conditions for step a) for treating the feed in the presence of hydrogen are usually conventional ebullated bed hydroconversion conditions for a liquid hydrocarbon feed. The operating conditions are normally an absolute pressure of 2 to 35 MPa, normally 5 to 20 MPa and usually 5 to 10 MPa at a temperature of about 300° C. to about 600° C. and usually about 350° C. to about 550° C. The hourly space velocity (HSV) and the hydrogen partial pressure are important factors that are selected as a function of the characteristics of the product to be treated and of the desired conversion. The HSV is usually in a range from about 0.1 $h^{-1}$ to about 10 $h^{-1}$, preferably about 0.5 $h^{-1}$ to about 5 $h^{-1}$. The quantity of hydrogen mixed with the feed is normally about 50 to about 5000 normal cubic meters ($Nm^3$) per cubic meter ($m^3$) of liquid feed and usually about 100 to about 1000 $Nm^3/m^3$ and preferably about 300 to about 500 $Nm^3/m^3$. A conventional granular hydroconversion catalyst can be used comprising, on an amorphous support, at least one metal or metal compound having an hydrodehydrogenating function. This catalyst can be a catalyst comprising group VIII metals, for example nickel and/or cobalt, usually in combination with at least one group VIB metal, for example molybdenum and/or tungsten. As an example, it is possible to use a catalyst comprising 0.5% to 10% by weight of nickel, preferably 1% to 5% by weight of nickel (expressed as nickel oxide NiO) and 1% to 30% by weight of molybdenum, preferably 5% to 20% by weight of molybdenum (expressed as molybdenum oxide ($MoO_3$) on an amorphous mineral support. This support is, for example, selected from the group formed by alumina, silica, silica-aluminas, magnesia, clays and mixtures of at least two of these minerals. This support can also comprise other compounds, for example oxides selected from the group formed by boron oxide, zirconia, titanium oxide, or phosphorous pentoxide. Usually, an alumina support is used, and more usually an alumina support doped with phosphorous and optionally boron. The concentration of phosphorous pentoxide $P_2O_5$ is normally less than about 20% by weight and usually less than about 10% by weight. This concentration of $P_2O_5$ is normally at least 0.001% by weight. The concentration of boron trioxide $B_2O_3$ is normally about 0 to about 10% by weight. The alumina used is normally a $\gamma$ or $\eta$ alumina. This catalyst is usually in the form of extrudates.

The total content of oxides of metals from groups VI and VIII is usually about 5% to about 40% by weight, and in general about 7% to 30% by weight and the weight ratio, expressed as the metallic oxide, of the group VI metal (or metals) to the group VIII metal (or metals) is in general about 20 to about 1, usually about 10 to about 2. Part of the used catalyst is replaced with fresh catalyst by withdrawal from the bottom of the reactor and introducing fresh or new catalyst to the top of the reactor at regular intervals, i.e., batchwise or quasi-continuously. As an example, fresh catalyst can be introduced every day. The ratio for replacing used catalyst with fresh catalyst can, for example, be about 0.05 kilograms to about 10 kilograms per cubic meter of feed. This withdrawal and replacement are carried out using apparatus enabling continuous operation of this hydroconversion step. The unit normally comprises a recirculating pump enabling the catalyst to be kept under ebullated bed conditions by continuously recycling at least a portion of the liquid withdrawn from the top of the reactor and reinjected into the reactor bottom. It is also possible to send the used catalyst withdrawn from the reactor to a regeneration zone in which the carbon and sulphur which it comprises are eliminated, then returning the regenerated catalyst to hydroconversion step a).

This hydroconversion step a) is usually carried out under the conditions of the T-STAR® process as described, for example, in the article "Heavy Oil Processing", published by Aiche, Mar. 19–23, 1995, Houston, Tex., paper number 42d. It can also be carried out under the conditions of the H-OIL® process as described, for example, in the article published by the NPRA Annual Meeting, Mar. 16–18, 1997, J. J. Colyar and L. I. Wilson, entitled "The H-Oil process, a world-wide leader in vacuum residue hydroprocessing".

The products obtained during this step a) are sent to a high pressure separation zone operating at a pressure and temperature that are substantially identical to the pressure and temperature of the converting treatment section of step a) from which a heavy liquid fraction and a lighter fraction are recovered. Normally, the initial boiling point of this heavy liquid fraction is about 350° C. to about 400° C., preferably about 360° C. to about 390° C., for example about 370° C. The lighter fraction is normally used in a fixed bed hydrodesulphurisation zone. The end point of this fraction is at most the initial point of the heavy liquid fraction given above. As an example, this fraction is the C5-370° C. fraction.

In the variation in which at least a fraction, preferably all, of fraction F2 from step b) is sent to a lower pressure separation section or to a fractionation column (step b1) after expansion, from which a light fraction F3 and a heavy fraction F4 are recovered, the pressure prevailing in this step b1) is lower than that in step b). Normally, the prevailing pressure in step b1) is less than 1.1 times, usually less than twice and more usually less than 5 times or even 10 times that prevailing in step b).

In hydrodesulphurisation step c), a conventional hydrodesulphurisation catalyst is usually used, preferably at least one of those described by the Applicant, in particular one of those described in patents EP-B-0 113 297 and EP-B-0 113 284. Generally, an absolute pressure substantially equal to the absolute pressure of step a) is used (i.e , close to the pressure drops between these two steps). The temperature in this step c) is generally about 250° C. to about 500° C., normally about 300° C. to about 450° C. and usually about 300° C. to about 420° C. This temperature is normally adjusted depending on the desired level of hydrodesulphurisation. The hourly space velocity (HSV) and the hydrogen partial pressure are important factors that are selected as a function of the characteristics of the product to be treated and of the desired conversion. The HSV is usually in a range from about 0.1 $h^{-1}$ to about 5 $h^{-1}$, preferably about 0.5 $h^{-1}$ to about 2 $h^{-1}$. The quantity of hydrogen mixed with the feed is normally about 100 to about 5000 normal cubic meters ($Nm^3$) per cubic meter ($m^3$) of liquid feed, usually about 200 to about 2000 $Nm^3/m^3$ and preferably about 300 to about 1000 $Nm^3/m^3$. It is normally carried out in the presence of hydrogen sulphide and the partial pressure of hydrogen sulphide is normally about 0.002 times to about 0.1 times, preferably about 0.005 times to about 0.05 times the total pressure. In the hydrodesulphurisation zone, the ideal catalyst must have a strong hydrogenating power in order to carry out deep refining of the products and to obtain a substantial reduction in sulphur content. In the preferred implementation, the hydrodesulphurisation zone is operated at a relatively low temperature that tends in the direction of deep hydrogenation and limiting coke formation. The scope of the present invention encompasses using a single catalyst or a plurality of different catalysts in the hydrodesulphurisation zone, simultaneously or successively. On the industrial scale, this step c) is normally carried out in one or more reactors in liquid dropper mode.

In the hydrodesulphurisation zone (step c), at least one fixed bed of conventional hydrodesulphurisation catalyst is used, the support of which is at least partially amorphous. Preferably, a catalyst is used with a support that is, for example, selected from the group formed by alumina, silica, silica-aluminas, magnesia, clays and mixtures of at least two of these minerals. This support can also comprise other compounds, for example oxides selected from the group formed by boron oxide, zirconia, titanium oxide and phosphorous pentoxide. Usually, an alumina support is used, more specifically an alumina support doped with phosphorous and possibly boron. The concentration of phosphorous pentoxide $P_2O_5$ is normally less than about 20% by weiaht and usually less than about 10% by weight. This concentration of $P_2O_5$ is normally at least 0.001% by weight. The concentration of boron trioxide $B_2O_3$ is normally about 0 to about 10% by weight. The alumina used is normally a $\gamma$ or a $\eta$ alumina. This catalyst is usually in the form of beads or extrudates. A conventional granular hydrodesulphurisation catalyst comprising at least one metal or metal compound with a hydrodehydrogenating function on an amorphous support can be used. This catalyst can be a catalyst comprising group VIII metals, for example nickel and/or cobalt, usually in combination with at least one group VIB metal, for example molybdenum and/or tungsten. As an example, it is possible to use a catalyst comprising 0.5% to 10% by weight of nickel, preferably 1% to 5% by weight of nickel (expressed as nickel oxide NiO) and 1% to 30% by weight of molybdenum, preferably 5% to 20% by weight of molybdenum (expressed as molybdenum oxide $MoO_3$) on an amorphous mineral support. The total amount of group VI and VIII metal oxides is usually about 5% to about 40% by weight, generally about 7% to 30% by weight and the weight ratio, expressed as the metal oxide, between the group VI metal (or metals) and the group VIII metal (or metals) is generally about 20 to about 1, usually about 10 to about 2.

In the distillation zone of step e), the conditions are generally selected such that the end point for the gas fraction is about 5° C. In this distillation zone, a gasoline fraction is also recovered with an end point which is usually about 150° C., and a gas oil fraction with an initial boiling point which is normally about 150° C. and an end point which is about 370° C.

In catalytic cracking step e) at least a portion of the heavy fraction F2 obtained in step b) or at least a portion of the fraction F4 obtained in step b1) is catalytically cracked in a conventional manner under conditions which are well known to the skilled person, to produce a fuel fraction (comprising a gasoline fraction and a gas oil fraction) at least a portion of which is normally sent to fuel storage zones and into a slurry fraction at least a portion or all of which, for example, is sent to the heavy fuel pool or at least a portion or all of which is recycled to catalytic cracking step d). In the present invention, the expression "catalytic cracking" encompasses all cracking processes comprising at least one step for regeneration by partial combustion and those comprising at least one step for regeneration by complete combustion and/or those comprising both at least one partial combustion step and at least one total combustion step.

As an example, a summary description of catalytic cracking (the first industrial use of which was in 1936) (Houdry process) or 1942 for the use of a fluidised bed catalyst) can be found in Ullmann's Encyclopaedia of Industrial Chemistry, Volume A 18, 1991, pages 61 to 64. Normally, a conventional catalyst comprising a matrix, an optional additive and at least one zeolite is used. The quantity of zeolite can vary but is normally about 3% to about 60% by weight, normally about 6% to 50% by weight and usually about 10% to 45% by weight. The zeolite is normally dispersed in the matrix. The quantity of additive is normally about 0 to 30% by weight and usually about 0 to 20% by weight. The quantity of matrix represents the complement to 100% by weight. The additive is generally selected from the group formed by oxides of metals from group IIA of the periodic table such as magnesium oxide or calcium oxide, rare earth oxides and titanates of group IIA metals. The matrix is usually a silica, an alumina, a silica-alumina, a silica-magnesia, a clay or a mixture of two of more of these products. The most frequently used zeolite is Y zeolite. Cracking is carried out in a substantially vertical reactor either in riser mode or in dropper mode. The choice of catalyst and the operating conditions depend on the desired products which depend on the treated feed as described, for example, in the article by M. Marcilly, pages 990–991 published in the French Petroleum Institute Review, November–December 1975, pages 969–1006 . Normally, the temperature is about 450° C. to about 600° C. and the residence times in the reactor are less than 1 minute, usually about 0.1 to about 50 seconds.

Catalytic cracking step d) can also be a fluidised bed catalytic cracking step, for example, using the R2R process developed by the Applicant. This step can be carried out conventionally in a known manner under suitable cracking conditions to produce lower molecular weight hydrocarbon products. Descriptions of the operation and catalysts suitable for fluidised bed cracking in step d) have been described, for example, in U.S. Pat. No. 4,695,370, EP-B-0-184 517, U.S. Pat. No. 4,959,334, EP-B-0 323 297, U.S. Pat. No. 4,965, 232, U.S. Pat. No. 5,120,691, U.S. Pat. No. 5,344,554, U.S. Pat. No. 5,449,496, EP-A-0 485 259, U.S. Pat. No. 5,286, 690, U.S. Pat. No. 5,324,696 and EP-A-0 699 224, the descriptions of which are hereby deemed to be incorporated in the present description by reference The fluidised bed catalytic cracking reactor can operate in riser or dropper mode. While this is not a preferred embodiment of the present invention, it is also possible to carry out catalytic cracking in a moving bed reactor. Particularly preferred catalytic cracking catalysts are those which contain at least one zeolite which is normally mixed with a suitable matrix such as alumina, silica or silica-alumina.

FIGS. 1, 2, 3 and 4 are diagrammatic representations of the process of the present invention. In the figures, similar means are designated by the same reference letters and numerals.

In FIG. 1, the hydrocarbon feed to be treated enters into a section (1) for treatment in the presence of hydrogen via lines 10 and 15, said hydrogen being introduced into said section via lines 19 and 15. Catalyst is added via line 16 and withdrawn via line 17. The effluent treated in section 1 is sent via line 18 to a high pressure, high temperature separation zone 2 from which an effluent which is depleted in fines is recovered via line 8 which is sent to fixed bed hydrodesulphurisation zone 4, while an effluent which is expanded in valve V1 is sent via line 7 to catalytic cracking section 6. In hydrodesulphurisation zone 4, hydrogen is introduced via line 9 and hydrotreated effluent is recovered and sent via line 100 to distillation zone D1 from which a gas fraction is recovered via line 11, a gasoline fraction is recovered via line 12 and a gas oil fraction is recovered via line 13. The catalytic cracking effluent is sent via line 110 to a distillation zone D2 from which a gas fraction is recovered via line 30, a gasoline fraction is recovered via line 31, a gas oil fraction is recovered via line 29 and a slurry fraction is recovered via line 32, part of which is sent to the heavy fuel pool of the refinery via line 33, a further portion of this slurry portion optionally being sent to catalytic cracking section 6 via lines 34 and 36, a further portion optionally being sent via line 35 to the ebullated bed treatment section 1. A portion of the gas oil fraction is optionally sent via line 39 and line 8 to fixed bed hydrodesulphurisation zone 4. A further portion of the gas oil fraction is optionally sent to catalytic cracking section 6 via line 38 and line 36. A portion of the gasoline fraction is optionally sent to catalytic cracking section 6 via line 37 and line 36.

Figure 2:
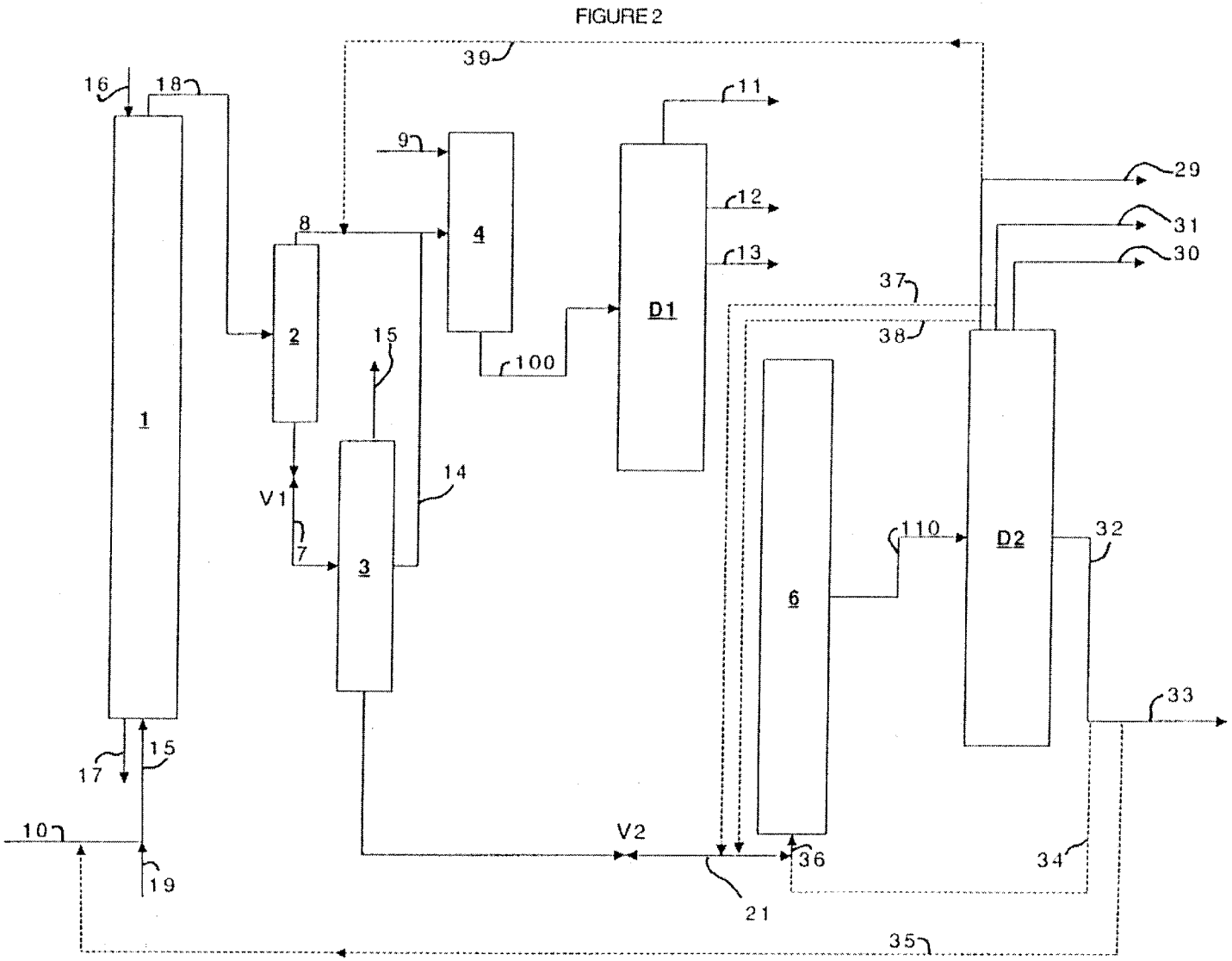

In a particular embodiment of the invention shown in FIG. 2, the effluent from high pressure, high temperature separation zone 2 circulating in line 7 is expanded in valve V1 and sent to lower pressure separation section 3 from which a gas fraction is recovered that is evacuated via line 15, a light effluent is recovered that is sent to hydrodesulphurisation zone 4 via line 14 and a heavier effluent is recovered via line 20 and depressurised in valve V2 then sent to catalytic cracking section 6.

Figure 3:
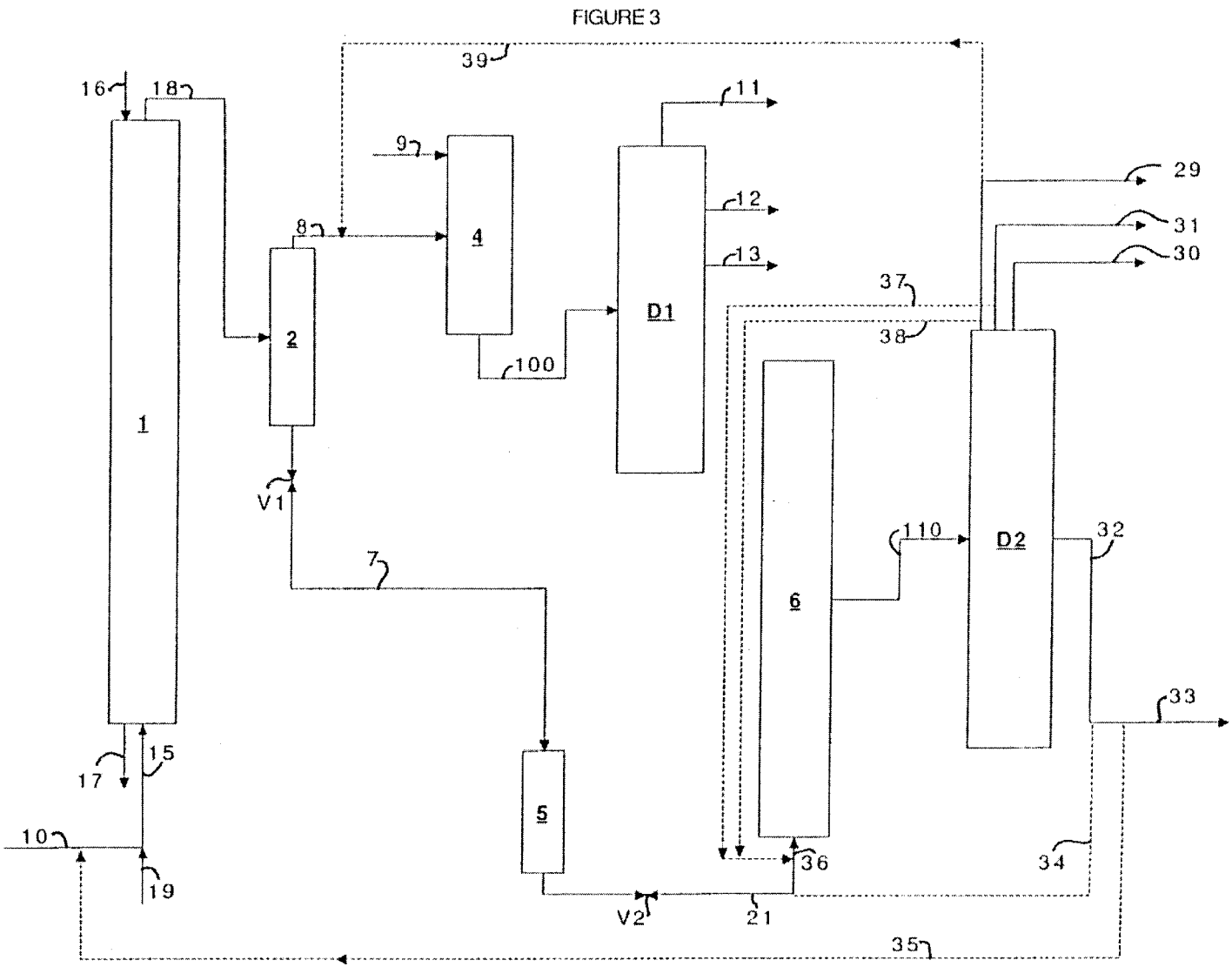

In a particular form of the invention shown in FIG. 3, the effluent from high pressure, high temperature separation zone 2 circulating in line 7 is depressurised in valve V1 then sent to a section 5 for eliminating catalyst fines from which an effluent that is substantially free of fine solid catalyst particles is recovered that, after depressurising in valve V2, is sent to catalytic cracking section 6 via line 21.

Figure 4:
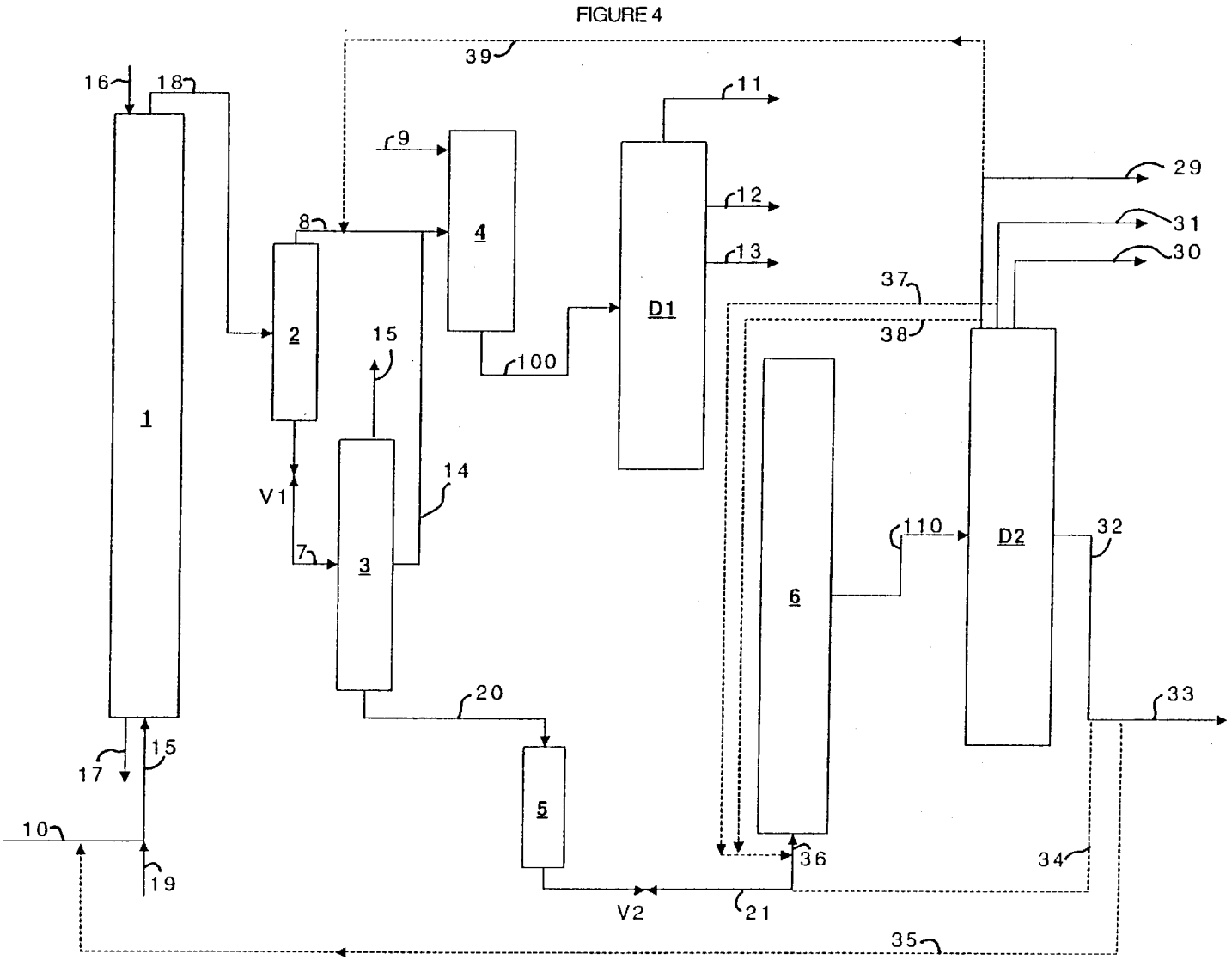

In a particular form of the invention shown in FIG. 4, the heavier effluent from lower pressure separation section 3 circulating in line 20 is sent to a section 5 for eliminating catalyst fines from which an effluent that is substantially free of fine solid catalyst particles is recovered that, after expanding in valve V2, is sent to catalytic cracking section 6 via line 21.

EXAMPLES

These examples are the results of experiments carried out in pilot units.

Example 1

A Safaniya heavy vacuum residue (VD) was treated. Its characteristics are shown in Table 1. The yields were calculated using the VD as the basis (100% by weight).

TABLE 1

| Safaniya VD feed | Analysis |
|---|---|
| 15/4 density | 0.940 |
| Sulphur, weight % | 3.08 |
| Conradson carbon, weight % | 1.2 |
| Nitrogen, ppm | 1092 |
| Hydrogen, weight % | 11.9 |
| Simulated distillation, weight % | ° C. |
| Temperature 5 | 366 |
| Temperature 50 | 488 |
| Temperature 95 | 578 |

This heavy Safaniya vacuum residue (VD) was treated in a pilot unit comprising an ebullated catalyst bed reactor.

This pilot unit simulated an industrial T-STAR® ebullated bed unit in riser mode. It has been shown elsewhere that this pilot unit produces results that are equivalent to those of industrial units.

The reactor contained 1 liter of a catalyst specific for T-STAR® applications, manufactured by PROCATALYSE under the trade name HTS358.

The operating conditions were as follows:
HSV with respect to packed catalyst bed: 1 $h^{-1}$;
hydrogen pressure: 6.5 bar (65 MPa);
hydrogen recycle: 400 liters of hydrogen per liter of feed;
temperatures in the reactors 440° C.

The liquid products from the first reactor were fractionated in line on the pilot unit into a gasoline fraction—atmospheric gas oil (C5-370° C.) and into a residual fraction (370° C.)

The C5-370° C. fraction was recovered and acted as the feed to a further fixed bed hydrodesulphurisation (HDS) pilot unit. This pilot comprised a fixed bed tube reactor. It was in riser mode in contrast to the case of an industrial unit. It has been shown elsewhere that this pilot unit produces results that are equivalent to those of industrial units comprising a fixed catalyst bed operating in fluid dropper mode. It was charged with 0.8 liters of HR448 catalyst sold by Procatalyse.

The operating conditions were as follows:
HSV with respect to packed catalyst bed: 1 $h^{-1}$;
hydrogen pressure: 65 bar (6.5 MPa);
hydrogen recycle: 600 liters of hydrogen per liter of feed;
temperatures in the reactors 350° C.

The liquid products from the first reactor were fractionated into a gasoline fraction C5-150° C. and an atmospheric gas oil fraction 150–370° C.

The material balance corresponding to the T-Star+HDS sequence is shown in Table 2. Note in particular the very substantial reduction in diesel that is obtained.

TABLE 2

| Material balance | T-Star + integrated HDS |
|---|---|
| $H_2S + NH_3$, wt %/feed | 3.2 |
| C1–C4, wt %/feed | 3.7 |
| C5–C150, wt %/feed | 9.0 |
| 150–370,wt %/feed | 48.0 |
| 370+, wt %/feed | 37.4 |
| Total, wt %/feed | 101.3 |

The qualities of the product corresponding to a T-Star+ integrated HDS sequence are shown in table 3 below. Particular note should be taken of the very good properties of the gas oil fraction obtained. Its sulphur content renders it compatible with European Community (EC) specifications for the year 2005.

TABLE 3

| | Products from T-Star + integrated HDS | |
|---|---|---|
| | Gasoline IP-150 | Gas oil 150–370 |
| Yield/VGO SR, wt % | 9.0 | 48.0 |
| 15/4 density | 0.730 | 0.853 |
| Sulphur, ppm by wt | <10 | 30 |
| (RON + MON)/2 | 60 | |
| Cetane | | 50 |

The residual fraction (370° C.⁻) resulting from fractionation was sent to a filtration system to eliminate catalyst fines generated in the reactor operating in ebullated bed mode. This prevented rapid deactivation of the fluidised catalytic cracking (FCC) catalyst as a result of the possible presence of molybdenum in the catalyst fines contained in this fraction.

This fraction containing no more catalyst fines was treated in a catalytic cracking pilot unit using a catalyst containing 20% by weight of Y zeolite and 80% by weight of a silica-alumina matrix. This feed, pre-heated to 135° C., was brought into contact at the bottom of a vertical pilot reactor with a hot regenerated catalyst from a pilot regenerator. The temperature at which the catalyst entered the reactor was 720° C. The ratio of the flow rate of the catalyst to the feed flow rate was 6.0. The heat energy added by the catalyst at 720° C. allowed the feed to vaporise and the cracking reaction, which is endothermic, to occur. The average residence time for the catalyst in the reaction zone was about 3 seconds. The operating pressure was 1.8 bars absolute. The temperature of the catalyst, measured at the outlet from the fluidised bed reactor in riser mode was 525° C. The cracked hydrocarbons and the catalyst were separated using cyclones located in a stripping zone where the catalyst was stripped. The catalyst coked during the reaction and stripped in the stripping zone was then sent to the regenerator. The coke content of the solid (delta coke) at the regenerator inlet was 0.85%. This coke was burned by air injected into the regenerator. The highly exothermic combustion raised the temperature of the solid from 525° C. to 720° C. The regenerated, hot catalyst left the regenerator and was returned to the bottom of the reactor.

The hydrocarbons separated from the catalyst left the stripper zone; they were cooled in exchangers and sent to a stabilisation column that separated the gas from the liquid. The liquid (C5+) was also sampled then fractionated in a further column to recover a gasoline fraction, a gas oil fraction and a heavy fuel fraction or slurry (370° C.). Table 4 shows the yields and principal characteristics of the products obtained.

TABLE 4

| | Products from FCC | |
|---|---|---|
| | Gasoline IP-220 | Gas oil 220–370 |
| Yield/VD SR, wt % | 19.6 | 6.2 |
| Sulphur, ppm by wt | 30 | 2700 |
| (RON + MON)/2 | 86 | |
| Cetane | | 28 |

The gasoline fraction recovered by distillation from the effluent from the outlet from the second reactor was then mixed with the gasoline fraction recovered from the product from the catalytic cracking and the same was done with the two gas oil fractions. Table 5 shows the total yields of gasoline and gas oil obtained and the principal characteristics of these products.

TABLE 5

| Total products | Total gasoline | Total gas oil |
|---|---|---|
| Yield/VGO SR, wt % | 28 6 | 54.2 |
| 15/4 density | 0.723 | 0.862 |
| Sulphur, ppm by wt | 24 | 350 |
| (RON + MON)/2 | 78 | |
| Cetane | | 47 |

The good properties of the gasoline cut can be seen, in particular its sulphur content that satisfies EC specifications for 2005. The high gas oil yields and its good cetane number can also be seen.

Example 2

The procedure of Example 1 was followed, using the same conditions, with the exception that the gas oil fraction from FCC was sent to the HDS step mixed with the C5-370° C. fraction recovered from the outlet from the T-Star process. An HDS test using the operating conditions cited above in the Example was carried out using the FCC fraction and the gas oil fraction mixed pro rata to the yields from each unit (T-Star and FCC).

The qualities of the product corresponding to a T-Star+ integrated HDS sequence with recycling of the FCC gas oil are shown in Table 6 below. Particular note should be taken of the very good properties of the gas oil fraction obtained. Its sulphur content renders it compatible with European Community (EC) specifications for the year 2005.

TABLE 6

| Products from T-Star + integrated HDS, recycling the FCC gas oil | Gasoline IP-150 | Gas oil 150–370 |
|---|---|---|
| Yield/VGO SR, wt % | 9.0 | 54.2 |
| 15/4 density | 0.730 | 0.858 |
| Sulphur, ppm by wt | <10 | 30 |
| (RON + MON)/2 | 60 | |
| Cetane | | 48 |

The gasoline fraction recovered by distillation of the effluent at the outlet from the HDS reactor was then mixed with the gasoline fraction recovered from the product from catalytic cracking. Table 7 shows the total yields of gasoline and gas oil and the principal characteristics of the products obtained.

TABLE 7

| Total products | Gasoline | Gas oil |
|---|---|---|
| Yield/ VGO SR, wt % | 28.6 | 54.2 |
| 15/4 density | 0.723 | 0.858 |
| Sulphur, ppm by wt | 24 | 30 |
| (RON + MON)/2 | 78 | |
| Cetane | | 48 |

Note in particular the very good properties of the gas oil fraction obtained. Its sulphur content rendered it compatible with the European Community (EC) specifications for 2005.

The good properties of the gasoline cut should also be noted, in particular the sulphur content which satisfies EC specifications for 2005. Note also the high gas oil yields and the very good cetane number.

What is claimed is:

1. A process for converting a hydrocarbon feed with a sulphur content of at least 0.05% by weight, an initial boiling point of at least 300° C., and an end boiling point of at least 400° C., comprising the following steps:

step (a): treating the hydrocarbon feed in the presence of hydrogen, in a first treatment section comprising at least one three-phase reactor, containing at least one hydroconversion catalyst containing an at least partially amorphous mineral support, in an ebullated bed, operating in liquid and gas riser mode, said reactor comprising at least one means (17) for withdrawing catalyst from said reactor located close to the reactor bottom and at least one means (16) for supplying fresh catalyst to said reactor located close to the top of said reactor so as to produce an effluent EF0;

step (b): sending at least a portion of the effluent EF0 from step a) to a separation section (2) operating at a pressure and temperature substantially identical to the pressure and temperature of the treatment section of step a), said separation section (2) producing a fraction F1 containing at least a portion of gas, gasoline and atmospheric gas oil contained in effluent EF0, and a fraction F2 principally containing compounds with boiling points that are higher than that of the atmospheric gas oil and a proportion of compounds with boiling points lower than those of the atmospheric gas oil;

(b1) sending at least a portion of the fraction F2 from step (b) to a fractionation column from which a gas fraction is obtained, a light fraction F3 is obtained, at least a portion of which is sent to the treatment section of step (c), and a heavy fraction F4 is obtained, at least a portion of which is sent to the catalytic cracking section of step d) after expansion;

step (c): sending at least a portion of the fraction F1 from step b) to a second treatment section, said treatment being carried out in the presence of hydrogen, said section comprising at least one reactor containing at least one fixed bed hydrodesulphurisation catalyst different than said hydro conversion catalyst wherein a mineral support is at least partially amorphous, under conditions enabling an effluent EF1 with a reduced sulphur content to be obtained; and step (d): after expansion, sending at least a portion of the fraction F2 from step b) to a catalytic cracking section in which it is treated under conditions that produce a cracking effluent EF2.

2. A process according to claim 1, further comprising step (e) at least part of the effluent EF1 obtained in step c) to a distillation zone from which a gas fraction, a gasoline fraction and a gas oil fraction are recovered.

3. A process according to claim 2, wherein at least a portion of the gasoline is sent to a gasoline pool and at least a portion of the gas oil is sent to a gas oil pool.

4. A process according to claim 1, in which catalytic cracking step d) is carried out under conditions for producing a cracking effluent EF2 containing a gas fraction, a gasoline fraction, a gas oil fraction and a slurry fraction.

5. A process according to claim 4, in which at least a portion of the cracking effluent EF2 obtained from catalytic cracking step (d) is sent to a distillation zone (step f) from which a gas fraction, a gasoline fraction, a gas oil fraction and a slurry fraction are recovered.

6. A process according to claim 5, wherein at least a portion of the gasoline fraction is sent to a gasoline pool and at least a portion of the gas oil fraction is sent to a gas oil pool.

7. A process according to claim 1, further comprising step (g) in which the fraction F2 from step b) or fraction F4 from step (b1) is sent to a section for separation and at least partial elimination of fine particles of catalyst before its introduction into catalytic cracking step (d) after expansion.

8. A process according to claim 1, in which step (g) comprises at least two means for at least partial separation and elimination of fine catalyst particles in parallel, wherein at least one conducts at least partial separation and elimination of fine catalyst particles while at least one other is purged of said fine particles that have been retained.

9. A process according to claim 3, in which at least a portion of the gas oil fraction obtained in step e) is recycled to step c).

10. A process according to claim 3, in which at least a portion of the gasoline fraction obtained in step e) is recycled to step (d).

11. A process according to claim 6, in which at least a portion of the slurry fraction obtained in step f) is recycled to step a) and/or step (d).

12. A process according to claim 1, in which step a) for treatment in the presence of hydrogen is carried out at an absolute pressure of 2 to 35 MPa, a temperature of about 300° C. to 600° C. and with an hourly space velocity of about 0.1 to 10 $h^{-1}$, and the quantity of hydrogen mixed with the feed is about 50 to 5000 $Nm^3/m^3$.

13. A process according to claim 1, in which hydrodesulphurisation step c) is carried out at a pressure substantially equal to the absolute pressure of step a), at a temperature of about 250° C. to 500° C. and with an hourly space velocity of about 0.1 to 5 $h^{-1}$, and the quantity of hydrogen mixed with the feed is about 100 to 5000 $Nm^3/m^3$.

14. A process according to claim 1, in which the feed comprises a vacuum distillate; a deasphalted oil; a mixture comprising a vacuum distillate and a member selected from the group consisting of at least one cycle oil, a gas cut from catalytic cracking, and a gas oil cut from coking; a mixture comprising a vacuum distillate and a deasphalted oil; or mixtures thereof.

15. A process according to claim 2, in which catalytic cracking step (d) is carried out under conditions for producing a cracking effluent EF2 containing a gas fraction, a gasoline fraction, a gas oil fraction and a slurry fraction.

16. A process according to claim 15, further comprising step (f) in which at least a portion of the cracking effluent EF2 obtained from catalytic cracking step d) is sent to a distillation zone from which a gas fraction, a gasoline fraction, a gas oil fraction and a slurry fraction are recovered.

17. A process according to claim 16, in which at least a portion of the gas oil fraction obtained in step e) and/or step f) is recycled to step c) and/or step d).

18. A process according to claim 16, in which at least a portion of the gasoline fraction obtained in step e) and/or step f) is recycled to step d).

19. A process according to claim 17, in which at least a portion of the slurry fraction obtained in step f) is recycled to step a) and/or step d).

20. A process according to claim 18, in which at least a portion of the slurry fraction obtained in step f) is recycled to step a) and/or step d).

21. A process according to claim 19, in which at least a portion of the gasoline fraction obtained in step e) and/or step f) is recycled to step d).

22. A process according to claim 1, wherein said feed consists essentially of a deasphalted oil.

23. A process according to claim 1, wherein said feed comprises essentially no asphalt fractions.

24. A process according to claim 1, wherein the feed consists essentially of no asphalt fractions.

25. A process according to claim 1, wherein said hydroconversion catalyst comprises 0.5% to 10% by weight of nickel and 1 to 30% by weight of molybdenum expressed as oxides.

26. A process according to claim 1, wherein the feed contains a sulfur content of over 2% by weight.

27. A process according to claim 1, wherein said feed has not been subjected to hydrodesulfurization prior to said hydrotreating.

28. A process according to claim 26, wherein said feed has not been subjected to hydrodesulfurization prior to said hydrotreating.

29. A process according to claim 1, wherein the feed contains a sulfur content of at least 1% by weight.

30. A process according to claim 26, wherein said feed has not been subjected to hydrodesulfurization prior to said hydrotreating.

* * * * *